United States Patent [19]

Thomas

[11] 4,301,570

[45] Nov. 24, 1981

[54] DOOR CHECK AND HOLDING DEVICE FOR A MOTOR VEHICLE

[75] Inventor: David H. Thomas, Woodburn, Ind.

[73] Assignee: International Harvester Company, Chicago, Ill.

[21] Appl. No.: 66,994

[22] Filed: Aug. 16, 1979

[51] Int. Cl.[3] ..... E05F 5/06

[52] U.S. Cl. ..... 16/85; 16/145

[58] Field of Search ..... 16/86 C, 85, 142, 145

[56] References Cited

U.S. PATENT DOCUMENTS

| | | | |
|---|---|---|---|
| 1,918,652 | 7/1933 | Marbach | 16/86 C |
| 2,074,398 | 3/1937 | Jacobs | 16/85 |
| 2,268,977 | 1/1942 | Westrope | 16/86 C |
| 2,314,416 | 3/1943 | Muldoon | 16/142 |
| 2,513,751 | 7/1950 | Semar | 16/85 |
| 2,577,456 | 12/1951 | Doman | 16/142 |
| 2,724,143 | 11/1955 | Galla | 16/86 C |

FOREIGN PATENT DOCUMENTS

| | | | |
|---|---|---|---|
| 832942 | 7/1938 | France | 16/85 |
| 506492 | 5/1939 | United Kingdom | 16/85 |

*Primary Examiner*—Andrew V. Kundrat

*Attorney, Agent, or Firm*—Raymond E. Parks; Frederick J. Krubel; F. David AuBuchon

[57] ABSTRACT

A motor truck door check and holding device comprising a spring bar having a cylindrical end portion pivotally connected to a swingable hinge half and having an elongated cam portion passing through an opening in the stationary hinge half. The cam portion has a hump which passes through the opening and springs upwardly and engages with the solid surface around the opening to hold the door in an open door position.

16 Claims, 5 Drawing Figures

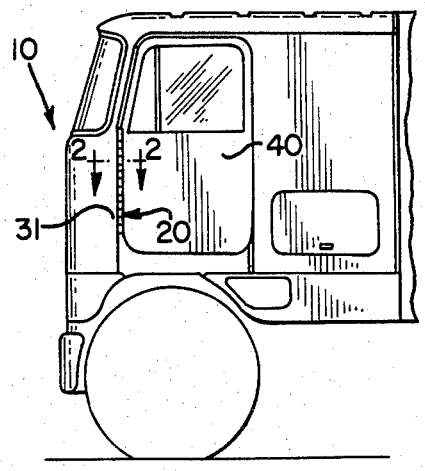
FIG. 1
FIG. 3
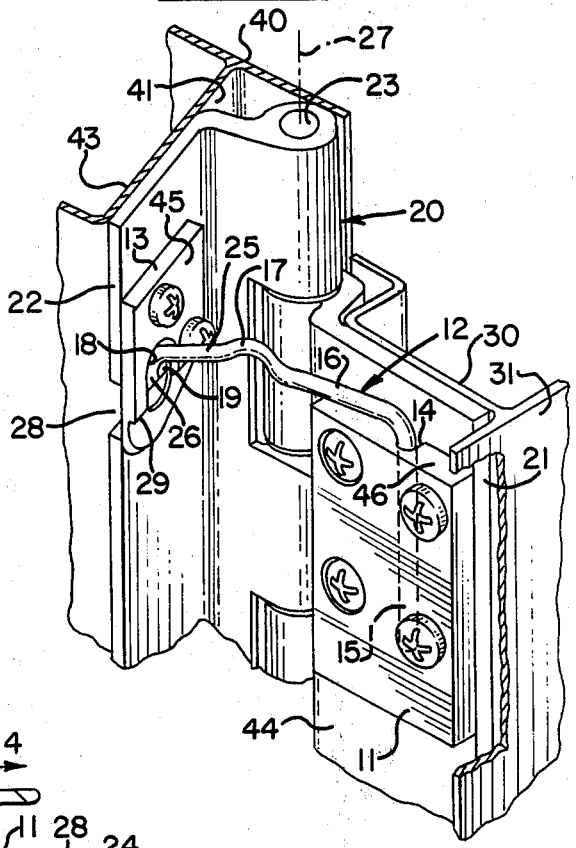
FIG. 2
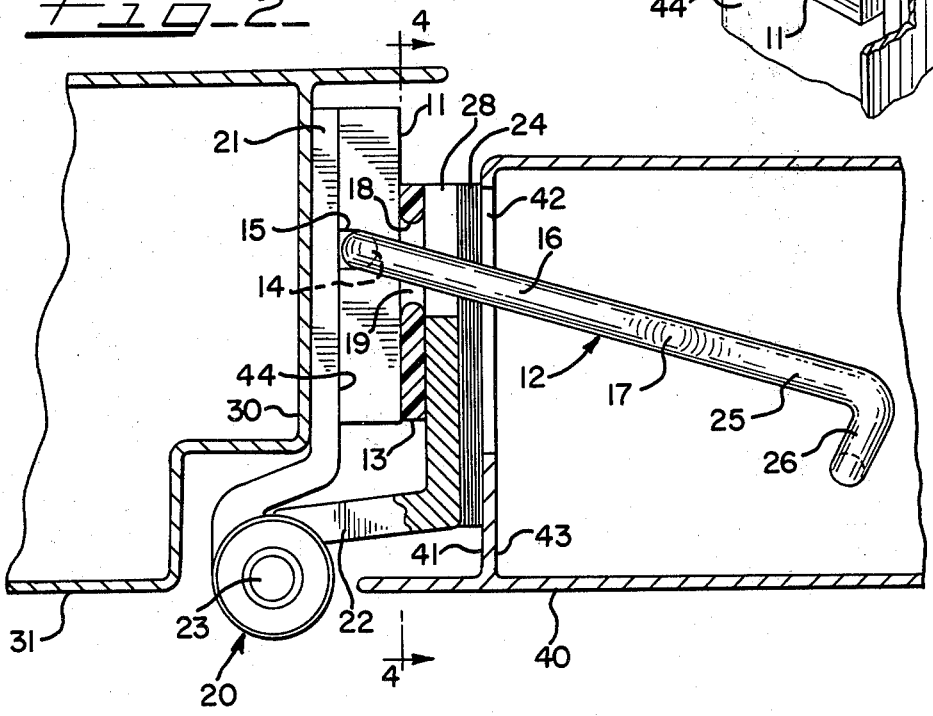

DOOR CHECK AND HOLDING DEVICE FOR A MOTOR VEHICLE

BACKGROUND OF THE INVENTION

This invention relates to vehicle doors and more particularly to door check and holding devices for motor truck vehicle doors.

FIELD OF THE INVENTION

In large motor vehicles, such as motor truck tractors, the cab doors are large and extremely heavy. These doors are usually hinged to the sides of the cab by a motor truck door hinge, which is similar to the so-called piano hinge, in order to distribute the weight evenly along the door support member. A door check and holding device is usually provided to hold the doors open in the open position in order to prevent them from closing due to the effect of wind or of their own weight.

DESCRIPTION OF THE STATE OF THE ART

In U.S. Pat. No. 2,039,960—Jacobs—May 5, 1936, the door check comprises a rod bent into the general shape of a hairpin which has flexible legs that are stepped at the curved end and engage with the side walls of a slotted opening upon opening of the door.

Another form of a generally hairpin shaped door check is shown in U.S. Pat. No. 3,165,777—Peras—Jan. 19, 1965. Here, the curved end serves as the anchor for the legs. One leg is bent at the end into a hook and the other leg is bent up against the hook and captures a roller in the hook at the open position of the door.

Both Jacobs and Peras require a rather long piece of spring steel wire and elaborate bending techniques to produce their door checks.

In U.S. Pat. No. 2,603,820—Allen—July 22, 1952 and U.S. Pat. No. 2,724,143—Galla—Nov. 22, 1955, the door check is in the form of a rigid rocker arm. Allen provides a bowlegged hairpin shaped spring on the swingable end which engages with a socket on the door; and Galla provides a dogleg bend on the swingable end which engages with a roller type of catch.

Both Allen and Galla require springs to engage the rocker arms with the catches.

Further examples of the above four types of door checks are shown in U.S. Pat. No. 2,039,961—Jacobs—May 5, 1936, U.S. Pat. No. 2,074,398—Jacobs Mar. 23, 1937, U.S. Pat. No. 2,032,600—Smith—Mar. 3, 1936, U.S. Pat. No. 2,232,498—Travis—Feb. 18, 1941, U.S. Pat. No. 2,237,046—Breitenwischer—Apr. 1, 1941,—U.S. Pat. No. 2,268,976—Westrope—Jan. 6, 1942, U.S. Pat. No. 2,291,412—Schonitzer—July 28, 1942, and U.S. Pat. No. 2,507,389—Travis et al—May 9, 1950.

SUMMARY OF THE INVENTION

In accordance with the invention, the door check and holding device for a motor vehicle door comprises a door hinge, a door check arm support plate having flat sides, a door check arm guide plate having flat sides and a door check arm. The door hinge is of the type having a stationary part, or half, adapted for mounting to a door frame, and a movable part, or half, which is hinge pin connected to the stationary part and is adapted for mounting to the fillister, or jamb face, of the door. The support plate is connected along one flat side to one of the hinge halves and has a vertically extending arched slot in the one flat side connected to the one hinge half.

The guide plate is connected along one flat side to the second hinge half and has an opening extending through both flat sides and registering with an opening or cutout provided in the second hinge half. The opening in the guide plate has a semi-rounded periphery and is oval in shape. The door check arm has an axial portion, which is journally mounted in the vertical slot in the support plate, an elongated spring portion, which passes through the openings in the guide plate and second hinge half and presses against the semi-rounded periphery in the oval opening in the guide plate, and a hooked terminal end means, which prevents the withdrawal of the terminal end means through the openings in the fully opened position of the door. The elongated spring portion is provided with a semi-circular raised or hump portion positioned at a predetermined distance which corresponds to the fully open position of the door and which engages against the second or outer flat side of the guide plate in the fully opened position of the door.

It is to be understood that the second hinge half can be connected to the fillister, or door jamb, or to the door frame, which, in either case, would require a hole therein for the accommodation of the elongated spring portion of the door check arm; and that the first hinge part also can be readily connected to the door frame of the the fillister, or door jamb.

The door check arm is made from a rod of spring steel which is formed into the general shape of an inverted L. One leg of the L is journally mounted in the vertical slot in the support plate member attached to one half of the motor truck hinge. The second leg of the L passes through the oval opening in the guide plate member attached to the second half of the motor truck hinge and through a corresponding opening or cut out in the second hinge half and through an opening in the door jamb in the mounted position of the movable hinge half to the door jamb. The second leg extends at a slight angle, or upward incline, with respect to the pivotal vertical axis of the first leg, for a distance slightly less than the opened position of the door, to form a cam-like spring surface which slides against the semi-round peripheral surface provided in the oval opening in the guide plate member, as the door is moved. The semicircular raised or hump portion is positioned at the end of the incline, and then merges into a substantially horizontal straight portion for a distance approximately equal to the combined thickness of the guide plate member, hinge shims, if required, and the fillister, or door jamb, at which point the terminal end is bent downwardly and offset from the vertical to form a hook which prevents the terminal end from being withdrawn through the aligned openings in the door jamb, second hinge half and guide plate member, by engaging with the solid area around the opening in the door jamb.

In the operation, as the raised portion or hump clears the aligned openings in the door jamb and second hinge half and impinges on the periphery of the oval opening in the guide plate member, the straight portion is deflected downwardly until the hump clears the oval opening and passes onto the second or outer side of the guide plate member, at which instant the straight portion springs back, upwardly, in the oval opening in the guide plate member, and the door is checked or anchored in place by the hump engaging the solid area around the oval opening on the outer flat side of the guide plate member and by the hook engaging the solid area or portion surrounding the opening in the door jamb.

In closing the door, the semi-circular peripheral surface of the oval opening in the guide plate member deflects the hump downwardly, as it passes back through said oval openings and into the opening in the door jamb, and the inclined spring portion pressing against the curved surface of said oval opening assists in closing the door due to the travel of the guide plate member now being in the incline downward direction of the spring portion of the door check arm means.

BRIEF DESCRIPTION OF THE DRAWINGS

FIG. 1 is a left side view of a motor truck cab;

FIG. 2 is a top sectional view taken on lines 2—2 of FIG. 1 across the motor truck hinge;

FIG. 3 is an inside cab view of the opened motor truck hinge and the noval door check and holding device;

DESCRIPTION OF THE PREFERRED EMBODIMENT

Figure 4:
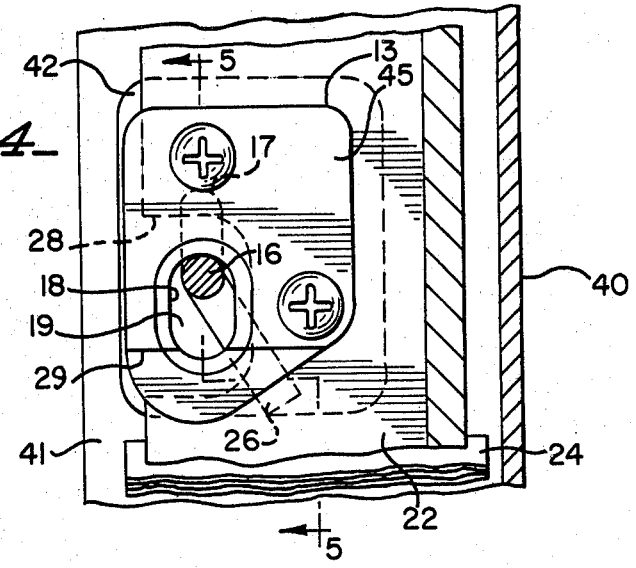
FIG. 4 is a frontal, partial cross-sectional view, of a motor truck door jamb showing parts of the novel door check and holding device taken on line 4—4 of FIG. 2.

In FIG. 1 there is shown a motor truck tractor vehicle 10, which has a cab 31 and a door 40 hinged to cab 31 by means of a motor truck door hinge assembly 20 which is similar to a piano hinge.

As shown in FIGS. 2 and 3, the motor truck door hinge assembly 20 comprises a stationary hinge half 21, and a movable or swingable hinge half 22. A hinge pin 23 pivotally connects the hinge halves 22, 21 together. The stationary hinge half 21 is connected to an upright wall member 30 forming a part of the supporting frame work for the motor truck cab door 40, and the movable hinge half 22 is connected to the door jamb or fillister 41 of the cab door 40.

Figure 5:
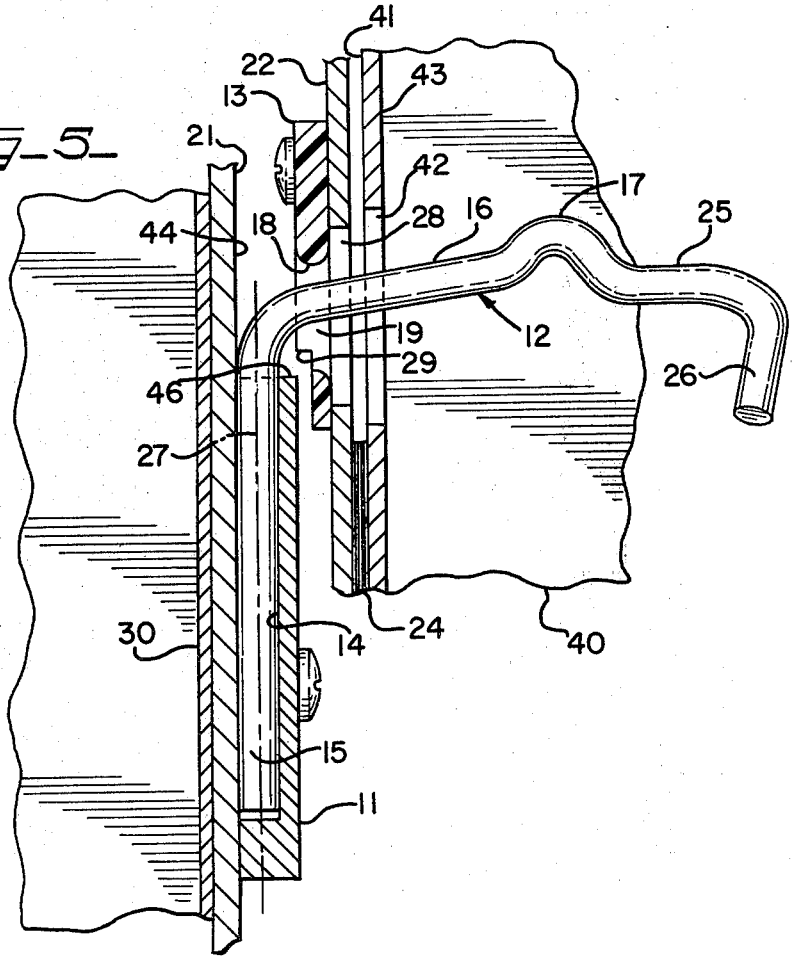
FIG. 5 is a frontal, partial cross-sectional view of the novel door check and holding device taken on line 5—5 of FIG. 4.

A flat support plate means 11, for supporting a door check arm means 12, is connected to the stationary hinge half 21, and a flat guide plate means 13, for guiding the door check arm means 12 through an opening 42 provided in the door jamb 41 is connected to the swingable hinge half 22. The support plate means 11 is provided with a vertical semi-cylinderical groove or arched channel 14 into which a straight cylinderical bearing portion 15 of the door check arm means 12 is pivotally carried and held against the outer surface 44 of the stationary hinge half 21. The check arm means 12, as shown in FIGS. 2, 3 and 5, is provided with a spring or cam portion 16 immediately following the straight cylindrical bearing portion 15. The spring portion 16 extends outwardly and upwardly from the bearing portion 15 and passes through the aligned openings 19, 28 and 42 and merges with a semi-circular raised portion or hump 17. The hump 17 functions as a wedge in combination with a top edge of a rounded continuous surface 18 around the generally oval shaped opening 19 provided in the guide plate means 13. Following the raised portion 17 there is a generally horizontally extending straight portion 25, that ends with a downwardly, obliquely extending, hooked portion 26. The hooked portion 26, as shown in FIGS. 3 and 4, prevents the door check arm means 12 from being pulled completely out through the opening 42 in the door jamb 41 once the hump portion 17 passes outwardly through the oval shaped opening 19 in the guide plate means 13. A clearance notch portion 29 is provided along a bottom section of the outward flat face 45 on the guide plate means 13 for clearing the upper portion 46 of the outer flat face on the support plate means 11 in the closed position of the door 40. Shims 24, if needed, are used between the movable hinge half 22 and the door jamb 41 for aligning the door 40.

MODE OF OPERATION

As the door 40 is being opened, the movable hinge portion 22 rotates about the axis 27 of the hinge pin 23 and the semi-circular periphery 18 of the oval opening 19 in the door check arm guide plate means 13 begins to slide over the outwardly and upwardly extending spring portion 16 of the door check arm means 12 and to deflect the spring portion 16 downwardly to ease the passage of the hump 17 through the oval opening 19 in the guide plate member 13. Once the hump 17 clears the oval opening 19, the hump 17 engages the external or outer flat side 45 of the guide plate means 13, concurrent with the straight portion 25 springing upwardly against the round-edged opening 19 and the hooked end portion 26 engaging the inner flat surface 43 about the opening 42 in the door jamb 41, thus checking the door 40 in an open position.

To close the door 40, sufficient force is applied to overcome the spring force of the door check arm means 12 in order to force the hump 17 to deflect downwardly within the oval opening 19 in the guide plate means 13 and then to pass through said oval opening and back into the interior of the door 40, the spring portion 16 now assisting in the closing of the door 40 due to the now downwardly inclined surface 17 sliding over the round-edge surface 18 of the oval opening 19 in the guide plate means 13.

What is claimed is:

1. A door check and holding device for a motor vehicle door, comprising:

a door hinge assembly having a stationary hinge half adapted for mounting to a support member of a motor truck cab, a movable hinge half adapted for mounting to a door jamb of the door, and a hinge pin pivotally connecting the halves together;

a support plate means having a flat side connected to one of the hinge halves and having a generally vertically extending slot in the flat side;

a guide plate means having a first flat side connected to the other one of the hinge halves and having an opening with a semi-rounded peripheral surface extending through the flat side and registering with an opening provided in said other one of the hinge halves; and a door check and holding arm means having a cylindrical axial portion journally mounted in the vertically extending slot in the support plate means and having an elongated spring portion extending outwardly and upwardly from the axial portion and passing through the openings in the guide plate means and said other one of the hinge halves and merging into a semi-circular raised portion at a predetermined horizontal distance from the axial portion corresponding to the fully open position of the door, the raised portion passable through the openings and engagable against a second flat side opposite the first flat side on the guide plate means in the fully opened position of the door, the raised portion curving downwardly and merging into a terminal end portion, the terminal end portion extending generally horizontally from the raised portion and bending into a downwardly and obliquely extending hook end means for preventing the withdrawal of the terminal end portion through the openings in the guide plate means and said other one of the hinge halves in the open position of the door.

2. A door check and holding device for a motor vehicle door, according to claim 1, wherein:

said other one of the hinge halves is the movable hinge half and a hole is provided in the door jamb registering with the openings in the movable hinge half and guide plate means; and wherein the hook end means passes through the hole in the door jamb in the mounted position of the movable hinge half to the door jamb and engages with the inside of the door in the open position of the door.

3. A door check and holding device for a motor vehicle door, according to claim 1, wherein:

said other one of the hinge halves is the stationary hinge half and a hole is provided in the support member of the motor truck cab registering with the openings in the stationary hinge half and guide plate in the mounted position of the stationary hinge half to the support member.

4. A door check and holding device for a motor vehicle door, according to claim 1 wherein:

the second flat side of the guide plate means overlaps the support plate means and wherein a cut-away section is provided in one of the two plate means permitting clearance for the two plate means in the closed position of the door.

5. A door check and holding device for a motor vehicle door, according to claim 4, wherein:

the cut-away section is provided in a bottom portion of the second flat side of the guide plate means.

6. A door check and holding device for a motor vehicle door, according to claim 1, wherein:

the opening in the guide plate means is an oval oriented to provide clearance for the deflection of the raised portion on the spring portion of the arm means when passing through the oval opening.

7. A door check and holding device for a motor vehicle door, according to claim 1, wherein:

the two plate means are each made from a plastic material and the arm means is made from a cylinderical rod of spring steel.

8. A door check and holding device for a motor vehicle door, according to claim 2, wherein:

the terminal end portion of the arm means extends horizontally for a predetermined distance which includes the combined thickness of the guide plate means and said other one of the hinge halves and the door jamb.

9. A door check and holding device for a motor vehicle door, according to claim 2, wherein:

the opening in the guide plate means is an oval oriented to provide clearance for the deflection of the raised portion on the spring portion of the arm means when passing through the oval opening.

10. A door check and holding device for a motor vehicle door, according to claim 4, wherein:

said other one of the hinge halves is the movable hinge half and a hole is provided in the door jamb registering with the openings in the movable hinge half and guide plate means; and wherein the hook end means passes through the hole in the door jamb in the mounted position of the movable hinge half to the door jamb and engages with the inside of the door in the open position of the door.

11. A door check and holding device for a motor vehicle door, according to claim 10, wherein:

the opening in the guide plate means is an oval oriented to provide clearance for the deflection of the raised portion on the spring portion of the arm means when passing through the oval opening.

12. A door check and holding device for a motor vehicle door, according to claim 10, wherein:

the terminal end portion of the arm means extends horizontally for a predetermined distance which includes the combined thickness of the guide plate means and said other one of the hinge halves and the door jamb.

13. A door check and holding device for a motor vehicle door, according to claim 6, wherein:

the second flat side of the guide plate means overlaps the support plate means and wherein a cut-away section is provided in one of the two plate means permitting clearance for the two plate means in the closed position of the door.

14. A door check and holding device for a motor vehicle door, according to claim 13, wherein:

the cut-away section is provided in the bottom portion of the second flat side of the guide plate means.

15. A door check and holding device for a motor vehicle door, according to claim 7, wherein:

the second flat side of the guide plate means overlaps the support plate means and wherein the cut-away section is provided in one of the two plate means permitting clearance for the two plate means in the closed position of the door.

16. A door check and holding device for a motor vehicle door, according to claim 15, wherein:

the cut-away section is provided in the bottom portion of the second flat side of the guide plate means.

* * * * *